US005271452A

United States Patent [19]

Lorento

[11] Patent Number: 5,271,452

[45] Date of Patent: Dec. 21, 1993

[54] CONTINUOUS CASTING METHOD AND APPARATUS

[75] Inventor: Donald P. Lorento, Exeter, Canada

[73] Assignee: SMS Concast Inc., Montvale, N.J.

[21] Appl. No.: 823,072

[22] Filed: Jan. 14, 1992

Related U.S. Application Data

[63] Continuation of Ser. No. 659,522, Feb. 22, 1991, abandoned, which is a continuation of Ser. No. 298,862, Jan. 13, 1989, abandoned, which is a continuation of Ser. No. 31,235, Mar. 26, 1987, abandoned.

[51] Int. Cl.[5] ..... B22D 11/00

[52] U.S. Cl. ..... 164/459; 164/418

[58] Field of Search ..... 164/459, 418

[56] References Cited

FOREIGN PATENT DOCUMENTS

| | | | |
|---|---|---|---|
| 899544 | 5/1984 | Belgium . | |
| 0309433 | 3/1989 | European Pat. Off. . | |
| 2518903 | 1/1976 | Fed. Rep. of Germany | 164/459 |
| 363129 | 8/1962 | Switzerland . | |
| 545664 | 2/1974 | Switzerland . | |
| 2109722 | 6/1983 | United Kingdom . | |

OTHER PUBLICATIONS

"Arch. Eisenhüttenwesen", 47, No. 7, pp. 441–446 (1976), Hatto Jacobi.

J. Savage & W. H. Pritchard, "Problem Of Rupture Of The Billet In The Continuous Casting Of Steel", Journal Of The Iron And Steel Institute, vol. 178 (Nov. 1954), pp. 269–277.

A. Ohno, "Continuous Casting Of Single Crystal Ingots By The O.C.C. Process", Journal Of Metals (Jan. 1986), pp. 14–16.

"Continuous Casting Of Steel In the USSR", Edited By Organization For Economic Cooperation And Development (1964), pp. 44–45.

*Primary Examiner*—Kuang Y. Lin

*Attorney, Agent, or Firm*—Peter K. Kontler; Tobias Lewenstein

[57] ABSTRACT

A continuous casting apparatus has a continuous casting mold which defines a casting passage. The walls of the mold are provided with conduits which are connected with a source of pressurized gas and open into the casting passage at locations downstream of that where the meniscus is normally established. During withdrawal of a continuously cast strand from the mold, gas is injected into the casting passage at a pressure sufficient to force the meniscus away from the walls of the mold. This eliminates the friction which normally exists between the mold and the meniscus so that the mold need not be oscillated during strand withdrawal. The continuous casting apparatus accordingly does not require an oscillating mechanism for the mold.

9 Claims, 2 Drawing Sheets

CONTINUOUS CASTING METHOD AND APPARATUS

This application is a continuation of application Ser. No. 07/659,522, filed Feb. 22, 1991, now abandoned, which is a continuation of Ser. No. 07/298,862, filed Jan. 13, 1989, now abandoned, which is a continuation of Ser. No. 07/031,235, filed Mar. 26, 1987, now abandoned.

CROSS-REFERENCE TO RELATED APPLICATION

This application discloses subject matter related to certain of the subject matter in the commonly owned U.S. Pat. application Ser. No. 872,956 of Herbert P. Fastert filed Jun. 11, 1986.

BACKGROUND OF THE INVENTION

The invention relates generally to continuous casting. More particularly, the invention relates to a continuous casting method and a continuous casting apparatus, especially a method of and an apparatus for continuously casting metals, e.g., steel.

In the continuous casting of steel, a stream of molten steel is continuously admitted into a first end of a casting passage defined by a continuous casting mold. The mold is cooled, and the molten steel adjacent to the walls of the mold solidifies to form a thin shell of solidified steel. The steel which is not immediately adjacent to the walls of the mold remains in the molten state and is confined within the solidified shell. The shell and its molten core together constitute a continuously cast strand.

The strand is continuously withdrawn from the mold via a second end of the casting passage. Outside of the mold, the strand is subjected to secondary cooling by water sprays in order to solidify the molten core.

The strand shell is in full contact with the mold at the trailing end of the strand, that is, at the location of the mold where solidification begins. Downstream of this location, the shell contracts from the mold due to the shrinkage which accompanies solidification and cooling. Consequently, a small air gap is present between the strand and the mold downstream of the trailing end of the strand.

The trailing end of the strand tends to stick to the mold. This condition is undesirable because the thin shell will tear under the action of the withdrawal force thereby resulting in poor surface quality or a breakout, i.e., an escape of the molten core. In order to prevent the shell from sticking to the mold, it has thus become the practice to oscillate or reciprocate the mold during casting.

While mold oscillation is effective in preventing sticking of the shell to the mold, a relatively expensive and complicated mechanism is required to oscillate the mold. Furthermore, undesirable oscillation marks are formed on the surface of the strand.

OBJECTS AND SUMMARY OF THE INVENTION

It is an object of the invention to provide a continuous casting method which enables better surface quality of a continuously cast strand to be achieved.

Another object of the invention is to provide a continuous casting method which allows mold oscillation to be eliminated.

An additional object of the invention is to provide a continuous casting method which makes it possible to eliminate oscillation marks on a continuously cast strand.

A further object of the invention is to provide a continuous casting apparatus which is capable of producing continuously cast strands having improved surface quality.

It is also an object of the invention to provide a continuous casting apparatus which does not require an oscillating mechanism for the mold.

Yet another object of the invention is to provide a continuous casting apparatus which makes it possible to produce continuously cast strands free of oscillation marks.

The preceding objects, and others which will become apparent as the description proceeds, are achieved by the invention.

One aspect of the invention resides in a continuous casting method which comprises the following steps:

A. Continuously admitting molten material, e.g., molten steel, into a first end of a casting passage defined by a continuous casting mold.

B. At least partially solidifying the molten material in the casting passage to form a continuously cast strand.

C. Continuously withdrawing the strand from the casting passage through a second end of the latter which is spaced from the first end thereof. The admitting and withdrawing steps are performed in such a manner that a trailing end of the strand, known as the meniscus, is located in the casting passage throughout the admitting step.

D. Establishing a layer of fluid between the mold and the trailing end of the strand.

E. Maintaining the fluid layer throughout at least the major part of the withdrawing step.

F. Maintaining the mold stationary throughout such part of the withdrawing step.

By establishing a layer of fluid between the mold and the trailing end of the strand, the tendency of the strand to stick to the mold may be eliminated. Since it was this tendency which led to mold oscillation in the first place, it follows that the invention makes it possible to operate without mold oscillation. This, in turn, makes it possible to dispense with an oscillator and allows oscillation marks to be eliminated.

Another aspect of the invention resides in a continuous casting apparatus. The apparatus includes a continuous casting mold which defines a casting passage, and means for establishing a layer of fluid between the mold and a trailing end of a continuously cast strand formed in the casting passage. The apparatus is devoid of means for reciprocating the mold.

The novel features which are considered as characteristic of the invention are set forth in particular in the appended claims. The improved continuous casting apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
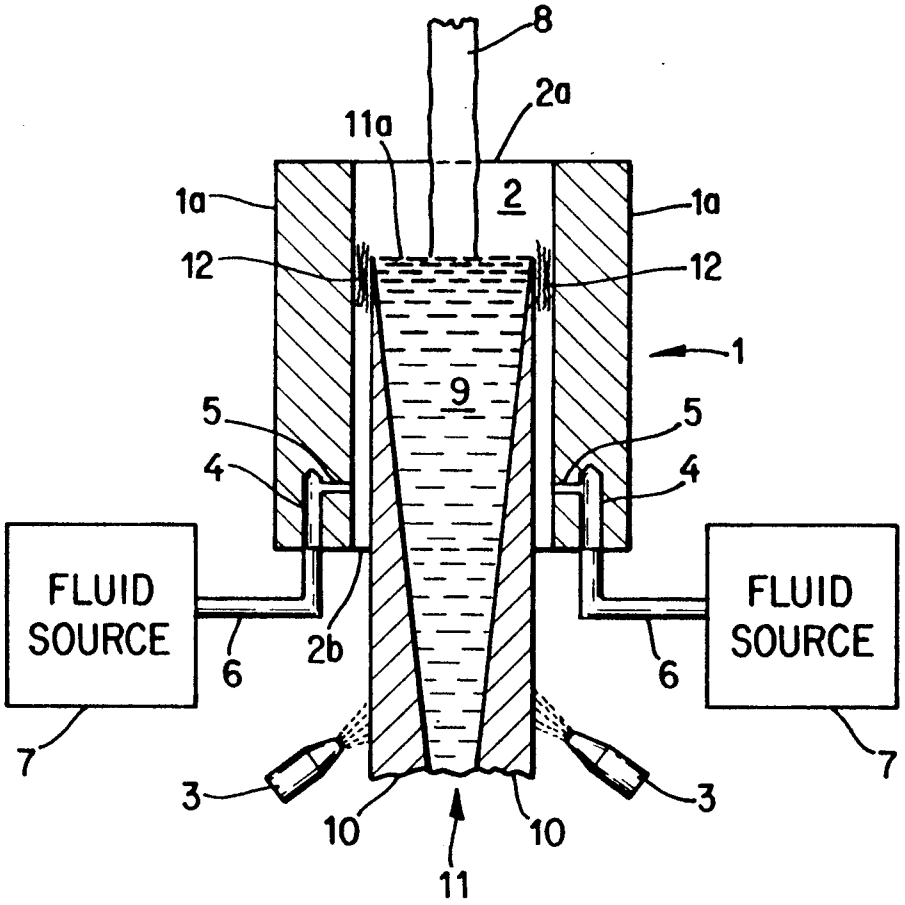
FIG. 1 is a schematic cross-sectional view of one embodiment of a continuous casting apparatus for carrying out a continuous casting method according to the invention.

Referring to FIG. 1, the reference numeral 1 identifies a continuous casting mold. The mold 1 has walls 1*a* which define and circumscribe a casting passage 2 extending longitudinally of the mold 1, and the casting passage 2 has an open inlet end 2*a* and an open outlet end 2*b*. The inlet end 2*a* and outlet end 2*b* are located at opposite longitudinal ends of the mold 1.

The mold 1, which is assumed to constitute part of an apparatus such as is used for the continuous casting of steel, may be made of copper or a copper alloy as known per se and is cooled in a conventional manner. The continuous casting apparatus is here shown as being of the vertical type, and the mold 1 is positioned with the casting passage 22 extending in a generally vertical direction. The casting passage 2 may be curved or straight. Spray nozzles 3 are disposed below the mold 1.

The walls 1*a* of the mold 1 are provided with two or more blind bores 4 in the region of the outlet end 2*b*. The bores 4, which are uniformly distributed circumferentially of the mold 1, extend longitudinally of the mold 1 and are open at the outlet end 2*b*. The walls 1*a* of the mold 1 are further provided with a plurality of channels 5 which extend radially, and are uniformly distributed circumferentially, of the mold 1. The channels 5 are located near the outlet end 2*b* of the mold 1, and each of the channels 5 opens to the casting passage 2 and one of the bores 4.

The plurality of channels 5 may be replaced by a single annular channel extending circumferentially of the casting passage 2.

The open end of each blind bore 4 is coupled to a pipe or tube 6. Each of the pipes 6 connects the respective bore 4 to a source 7 of pressurized fluid. While each bore 4 is illustrated as being connected to an individual fluid source 7, a common fluid source may be provided for all of the bores 4.

In operation, a dummy bar is fed into the casting passage 2 so as to close the outlet end 2*b*. The dummy bar is sealed in a conventional manner and chill scrap is placed on the dummy bar as usual. Once the dummy bar has been prepared, cooling water is circulated through the walls 1*a* of the mold 1 and a stream 8 of molten metal, e.g., molten steel, is teemed into the casting passage 2 from a non-illustrated ladle and tundish. The initial quantity of molten metal admitted into the casting passage 2 solidifies upon contacting the dummy bar and forms a connection with the latter. The dummy bar is now withdrawn from the casting passage 2 via the outlet end 2*b* while molten metal continues to be admitted into the casting passage 2.

The molten metal which continues to be teemed into the casting passage 2 as the dummy bar is withdrawn forms a pool 9 in the casting passage 2. The molten metal which is adjacent to the walls of the mold 1 solidifies to form a shell or skin 10 which surrounds the pool 9. The shell 10 and pool 9 together constitute a continuously cast strand 11 which is continuously withdrawn from the casting passage 2 via the outlet end 2*b*. Withdrawal of the dummy bar and the strand 11 from the casting passage 2 is performed by a conventional, non-illustrated withdrawal unit or combined straightening and withdrawal unit.

The strand 11 has a trailing end 11*a* which is located inside the casting passage 2 near the inlet end 2*a*. The trailing end 11*a* is known in the art as the meniscus and is the point where the shell 10 just begins to form. The rate of admission of molten metal into the casting passage 2 is matched to the rate of withdrawal of the strand 11 therefrom so that the net amount of metal leaving or entering the casting passage 2 is essentially zero. Therefore, the position of the trailing end 11*a* remains fairly stable.

The strand 11 is continuously cooled during withdrawal from the casting passage 2 so that the thickness of the shell 10 increases progressively in a direction away from the trailing end 11*a*. Cooling inside the casting passage 2 is due to the water which is circulated through the walls 1*a* of the mold 1. Outside of the casting passage 2, the strand 11 is cooled by means of water sprays from the nozzles 3. Cooling of the strand 11 continues until the latter is solidified throughout.

The trailing end 11*a* of the strand 11 tends to contact and stick to the walls 1*a* of the mold 1. In contrast, a small gap tends to develop between the strand 11 and the mold 1 downstream of the trailing end 11*a* due to the contraction which accompanies cooling and progressive solidification of the strand 11, i.e., the strand 11 tends to shrink away from the mold 1 downstream of the trailing end 11*a*.

If the trailing end 11*a* is permitted to stick to the mold 1, the shell 10 will tear in the region of the trailing end 11*a* under the action of the withdrawal force. The reason is that the shell 10 is very thin and very hot, and consequently very weak, in the vicinity of the trailing end 11*a*. Tearing of the shell 10 is not only bad for the surface quality of the strand 11 but may also result in a breakout, i.e., an escape of the molten core 9 of the strand 11.

To overcome the tendency of the trailing end to stick to the mold, it has become the practice to oscillate or reciprocate the mold. This involves movement of the mold back-and-forth along the path of the strand with a stroke of approximately one-eighth to one-quarter of an inch. Oscillation of the mold not only requires a relatively complicated and expensive oscillating mechanism but also produces so-called oscillation marks on the surface of the strand.

The invention makes it possible to prevent the trailing end 11*a* of the strand 11 from sticking to the mold 1 while maintaining the mold 1 stationary. This is accomplished by establishing a layer 12 of fluid between the mold 1 and the trailing end 11*a*.

The fluid layer 12 is formed by admitting fluid from the fluid sources 7 into the casting passage 2. The flow rate is set so that the trailing end 11*a* of the strand 11 is lifted away from, and thus prevented from contacting, the mold 1. Accordingly, the trailing end 11*a* cannot stick to the mold 1 and it becomes unnecessary to reciprocate the latter. The flow of fluid into the casting passage 2 is initiated when withdrawal of the strand 11 from the mold 7 begins and is continued until such time as the admission of molten metal into the mold 1 is terminated and the trailing end 11*a* is capped and withdrawn from the mold 1.

The fluid supplied by the sources 7 may be a gas, or a liquid which vaporizes when exposed to the temperatures existing in the casting passage 2 during a continuous casting operation. In selecting the fluid, an important consideration is the thermal conductivity of the gas which ultimately forms the fluid layer 12. If the thermal conductivity is too low, heat transfer between the strand 11 and the mold 1 will be reduced to such an extent that the shell 10 is unable to form properly. The result may be a breakout.

As mentioned previously, the mold 1 is cooled in a conventional manner. This involves the circulation of cooling water through cooling channels formed in the walls 1*a* of the mold 1. By measuring the temperature of the water as it enters the mold 1 and the temperature upon leaving the mold 1, it is possible to make a rapid and simple experimental determination of whether the thermal conductivity of a given fluid is adequate for a particular set of casting parameters. If the temperature differential approaches zero as the pressure of the fluid is increased to establish the fluid layer 12, the thermal conductivity of the fluid is too low. On the other hand, if the temperature differential increases, remains unchanged or decreases by only a limited amount as the pressure of the fluid is increased, the thermal conductivity of the fluid is adequate.

By way of example, trials were conducted in a machine for the continuous casting of steel. In a first trial, argon was used as a fluid. The thermal conductivity of argon at 32° F. is 0.00915 Btu per hour per square foot per °F. per foot. As the argon pressure was increased, the temperature differential of the cooling water decreased rapidly from an initial value of 18° F. to 0° thereby indicating that the thermal conductivity of argon is too low to maintain adequate heat transfer between the strand 11 and the mold 1 in the presence of the fluid layer 12. In fact, the trial had to be cut short to prevent a breakout. A second trial was then conducted with helium which has a thermal conductivity of 0.0818 Btu per hour per square foot per °F. per foot at 32° F. In this case, the temperature differential of the cooling water, which was again 18° F. prior to initiating the flow of helium into the casting passage 2, had decreased by only 6° F., i.e., had decreased to a value of 12° F., upon establishment of the fluid layer 12. This indicated that the thermal conductivity of helium is high enough to prevent total elimination of heat transfer between the strand 11 and the mold 1 in the presence of the fluid layer 12. The heat transfer under these conditions was sufficient to permit development of the shell 10 and performance of continuous casting.

In general, any gaseous substance having a thermal conductivity equal to or greater than that of helium may be used to establish the fluid layer 12.

As mentioned previously, the mold 1 is maintained stationary during continuous casting, that is, during the admission of molten metal into, and withdrawal of the strand 11 from, the casting passage 2. Accordingly, the continuous casting apparatus of FIG. 1 does not require an oscillating mechanism for the mold 1 and is devoid of such a mechanism. This enables the complexity and cost of the apparatus to be reduced.

Figure 2:
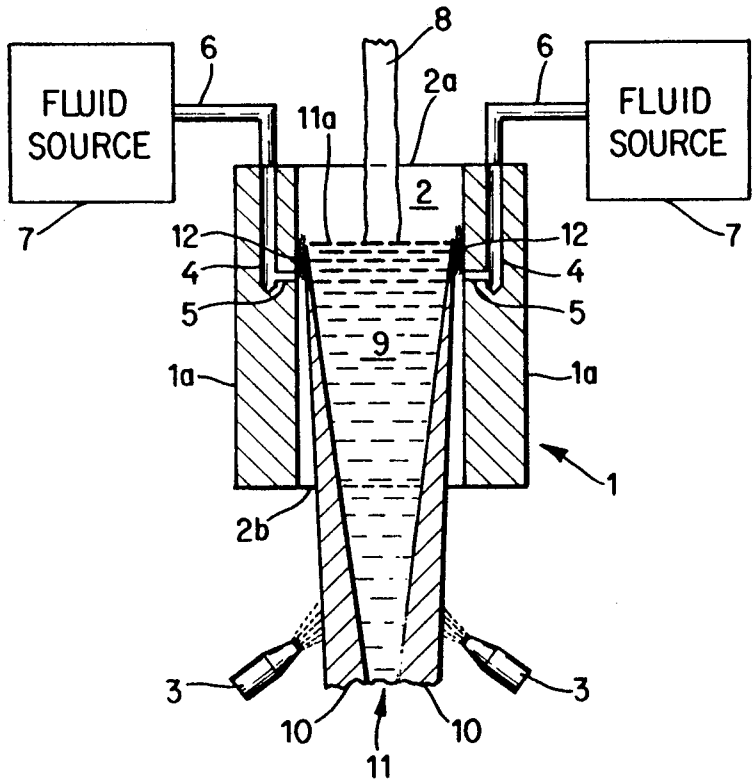
FIG. 2 is similar to FIG. 1 but illustrates another embodiment of a continuous casting apparatus for carrying out a continuous casting method in accordance with the invention.

FIG. 2 illustrates an arrangement which differs from that of FIG. 1 in that the blind bores 4 are provided in the region of, and are open at, the inlet end 2*a* rather than the outlet end 2*b* of the mold 1. The channels 5 are located in the region, but immediately or slightly downstream, of the trailing end 11*a* of the strand 11. Since the trailing end 11*a* is normally located much nearer the inlet end 2*a* than the outlet end 2*b*, the channels 5 are likewise disposed nearer the inlet end 2*a* than the outlet end 2*b*.

The operation of the continuous casting apparatus of FIG. 2 is the same as that of FIG. 1 except that the fluid for establishing the fluid layer 12 is introduced into the casting passage 2 immediately or slightly downstream, instead of well downstream, of the trailing end 11*a* of the strand 11.

Figure 3:
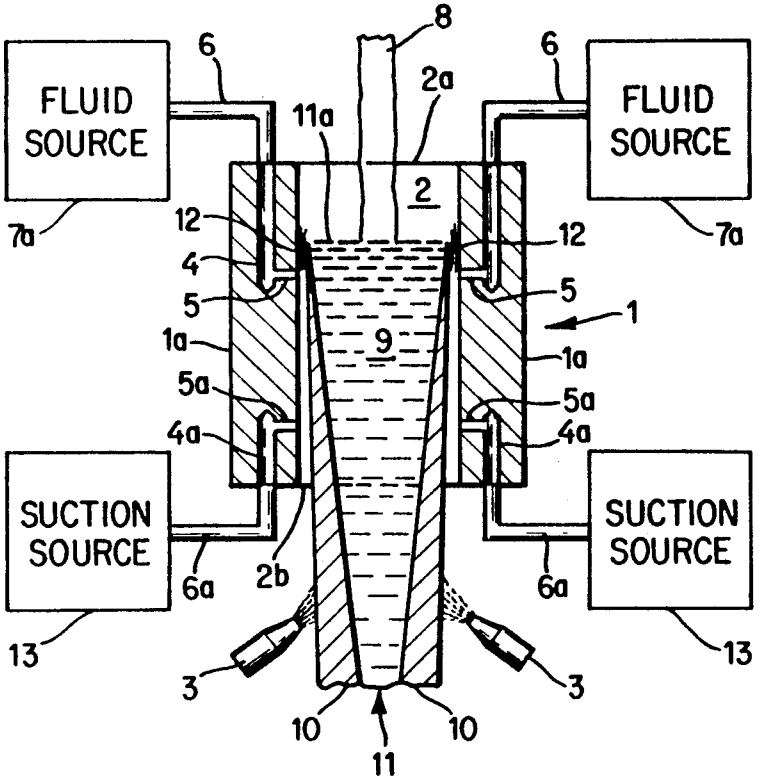
FIG. 3 is similar to FIG. 2 but illustrates a further embodiment of a continuous casting apparatus for carrying out a continuous casting method according to the invention.

FIG. 3 illustrates another embodiment of a continuous casting apparatus. The walls 1*a* of the mold 1 are here provided with two or more blind bores 4*a* in addition to the bores 4. The bores 4*a* are located in the region of the outlet end 2*b* of the casting passage 2 and extend longitudinally of the mold 1. Furthermore, the bores 4*a* are uniformly distributed circumferentially of the mold 1 and are open at the outlet end 2*b*.

The walls 1*a* of the mold 1 are additionally provided with a plurality of channels 5*a* which extend radially, and are uniformly distributed circumferentially, of the mold 1. The channels 5*a* are disposed near the outlet end 2*b*, and each of the channels 5*a* opens to the casting passage 2 and one of the bores 4*a*.

The plurality of channels 5*a* may be replaced by a single annular channel extending circumferentially of the casting passage 2.

The open end of each blind bore 4*a* is coupled to a pipe or tube 6*a*. Each of the pipes 6*a* connects the respective bore 4*a* to a source 13 of suction, e.g., a vacuum pump. Although each bore 4*a* is shown as being connected to an individual suction source 13, a common suction source may be provided for all of the bores 4*a*.

The bores 4 and channels 5 in FIG. 3 are situated in the same manner as in FIG. 2. However, instead of being connected with sources 7 of fluid having a relatively high thermal conductivity, i.e., a thermal conductivity which at least approaches that of helium, the bores 4 of FIG. 3 are connected with sources 7*a* of pressurized fluid having a relatively low thermal conductivity, that is, a thermal conductivity significantly lower than that of helium. The individual fluid sources 7*a* shown in FIG. 3 may again be replaced by a single fluid source common to all of the bores 4.

The fluid supplied by the sources 7*a* may be a gas, or a liquid which vaporizes when exposed to the temperatures existing in the casting passage 2 during a continuous casting operation. Presently preferred fluids are nitrogen and the heavier inert gases, especially argon.

The operation of the continuous casting apparatus of FIG. 3 is the same as that of the apparatus of FIGS. 1 and 2 except that now suction is applied to the casting passage 2 via the suction sources 13 while fluid from the fluid sources 7*a* is admitted into the casting passage 2 so as to establish the fluid layer 12. Both suction and the admission of fluid into the casting passage 2 are initiated at the time that withdrawal of the strand 11 begins and continued until the trailing end 11*a* of the strand 11 is capped and withdrawn from the mold 1 at the end of the continuous casting operation.

It is known that water which issues from the spray nozzles 3 and impinges upon the strand 11 not only vaporizes but also decomposes to yield hydrogen. The suction sources 13 serve to draw such hydrogen into the casting passage 2. The thermal conductivity of hydrogen is quite high, i.e., 0.0966 Btu per hour per square foot per °F. per foot at 32° F., and the drawing of hydrogen into the casting passage 2 functions to improve the heat transfer between the strand 11 and the mold 1. This improvement in heat transfer compensates for the reduction in heat transfer due to the relatively low thermal conductivity of the fluid which is supplied by the fluid sources 7*a* and forms the fluid layer 12.

The arrangement of FIG. 3 has the advantage that the fluid used to establish the fluid layer 12 need not have a relatively high thermal conductivity. This provides greater flexibility in the selection of the fluid.

It will be appreciated that an important feature of the invention resides in eliminating or reducing friction between the mold 1 and the trailing end 11*a* of the strand 11. To this end, the fluid supplied by the sources 7 and 7*a* may include an oil mist or a powdered lubricant, e.g., slag powder.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A continuous casting method, comprising the steps of continuously admitting molten material into a first longitudinal end of a casting passage defined by a continuous casting mold; at least partially solidifying said molten material in said passage to form a continuously cast strand; non-electromagnetically confining said strand in said passage radially of the latter; continuously withdrawing said strand from said passage through a second longitudinal end of the latter which is spaced from said first end, the admitting and withdrawing steps being performed in such a manner that a trailing end of said strand is located in said passage essentially throughout the admitting step; establishing a layer of fluid between said trailing end and said mold; maintaining said layer throughout at least the major part of the withdrawing step; maintaining said mold stationary throughout said part of the withdrawing step; and generating suction in said passage downstream of said trailing end, the generating step being performed during the step of maintaining said layer.

2. The method of claim 1, wherein the generating step is performed in the region of said second end.

3. The method of claim 1, wherein the steps of establishing and maintaining said layer comprise introducing said fluid into said passage at a first location downstream of said trailing end, the generating step being performed at a second location intermediate said first location and said second end.

4. The method of claim 1, wherein said fluid is a gas.

5. The method of claim 4, wherein said gas is an inert gas.

6. The method of claim 5, wherein said gas is argon.

7. The method of claim 4, wherein said gas is nitrogen.

8. A continuous casting apparatus, comprising a continuous casting mold defining a casting passage, said mold including wall means which circumscribes said passage, and said passage having a longitudinal inlet end for molten material and a longitudinal outlet end for a continuously cast strand formed in said passage; means for generating suction in said passage, said generating means comprising a source of suction, and at least one conduit in said wall means communicating with said suction source and opening to said passage in the region of said outlet end; and means for establishing a layer of fluid between said mold and a trailing end of the continuously cast strand formed in said passage, said apparatus being devoid of means for electromagnetically confining the strand in said passage radially of the latter and of means for reciprocating said mold.

9. A continuous casting apparatus, comprising a continuous casting mold defining a casting passage, said mold including wall means which circumscribes said passage, and said passage having a longitudinal inlet end for molten material and a longitudinal outlet end for a continuously cast strand formed in said passage; means for generating suction in said passage, said generating means comprising a source of suction, and at least one conduit in said wall means communicating with said suction source and opening to said passage; and means for establishing a layer of fluid between said mold and a trailing end of the continuously cast strand formed in said passage, said establishing means comprising a source of fluid, and an additional conduit in said wall means communicating with said fluid source and opening to said passage at a first location, said one conduit opening to said passage at a second location between said first location and said outlet end.

* * * * *